US005852344A

United States Patent [19]

Sanders et al.

[11] Patent Number: 5,852,344

[45] Date of Patent: Dec. 22, 1998

[54] ENCLOSURE FOR GLOW BULB STARTER USED WITH GAS DISCHARGE LAMPS

[75] Inventors: Stuart E. Sanders, Brandon, Miss.; John L. Cox, Hermitage, Tenn.; David S. Stratton, Douglas, Ariz.; Theodore Miller, Jr., Hattiesburg; Mark R. Opperthauser, Brandon, both of Miss.

[73] Assignee: MagneTek, Inc., Nashville, Tenn.

[21] Appl. No.: 686,661

[22] Filed: Jul. 26, 1996

[51] Int. Cl.[6] ..... H01J 7/44

[52] U.S. Cl. ..... 315/61; 313/58; 313/63; 315/61

[58] Field of Search ..... 313/63, 58; 315/61

[56] References Cited

U.S. PATENT DOCUMENTS 4,347,460 8/1982 Latassa et al. ..... 313/63
4,495,443 1/1985 Cummings ..... 315/58
4,879,494 11/1989 Tuttle ..... 315/61
4,931,696 6/1990 Brower ..... 315/61

*Primary Examiner*—Sandra L. O'Shea
*Assistant Examiner*—Matthew J. Gerike
*Attorney, Agent, or Firm*—Waddey & Patterson; Mark J. Patterson

[57] ABSTRACT

An one-piece plastic protective enclosure is provided for a glow bulb used as a starter for a fluorescent lamp. The enclosure has a latching hinged lid, a partition wall to isolate the glow bulb leads, and integral strain relief. The glow bulb enclosure is mounted inside a ballast assembly and the glow bulb leads are ultrasonically welded to the ballast power supply wires.

20 Claims, 3 Drawing Sheets

ENCLOSURE FOR GLOW BULB STARTER USED WITH GAS DISCHARGE LAMPS

BACKGROUND OF THE INVENTION

This invention pertains generally to glow bulbs which are conventionally used as starting devices for gas discharge lamps. More specifically, this invention pertains to techniques for electrically, thermally, and mechanically insulating a glow bulb starter from the ballast and other components associated with a gas discharge lamp.

Fluorescent lamps provide illumination by generating an electrical arc and radiation inside a lamp tube. The radiation activates a fluorescent coating applied to the inner surface of the tube. To produce the arc and radiation inside the tube, a voltage is applied to the electrodes of the lamp at sufficiently high levels to generate an arc across electrodes. However, conventional fluorescent lamps must be "started" by ionizing the gas within the lamp so that the breakdown voltage needed to initiate the arc between the electrodes is reduced to a reasonably low level.

To provide the starting voltage and to control the current to the lamp, a ballast is used. In many low wattage fluorescent lamps, a magnetic ballast is used in conjunction with a glow bulb starter. The ballast limits the current to the lamp while the glow bulb starter creates an arc-inducing voltage spike across the lamp after pre-heating the lamp electrodes. Generally, the glow bulb starting device is mounted internal to the ballast enclosure. This presents a number of problems with the integrity, cost, and reliability of the ballast assembly, both in manufacturing and in operation.

First, some level of electrical isolation must be provided between the glow bulb and the other components of the ballast. Second, the glow bulb must be protected from thermal shock caused when potting compound is poured at high temperature into the ballast enclosure. Third, a secure and relatively efficient means must be used to electrically connect the leads on the glow bulb to power supply leads inside the ballast enclosure.

Several thermal and electrical isolation techniques have been used in the prior art but with limited success. Some manufacturers isolate the glow bulb lead wires from each other by covering them with dielectric tubing and tape and then wrapping the entire glow bulb and glow bulb lead assembly in Mylar tape. Other manufacturers use a paper insulation material to isolate the glow bulb from the other components in the ballast. In either case, the wrapping of the glow bulb with tape or other material is highly labor intensive and does not provide a high level of mechanical or thermal protection for the glow bulb itself. Accordingly, the glow bulbs which are installed and protected using prior art techniques are prone to failure due to thermal effects or mechanical shock.

What is needed, then, is a device for electrically insulating glow bulb leads from each other and from the other internal components of a ballast, which provides a high level of thermal and mechanical protection to the glow bulb, and which reduces the cost of installing and assembling the glow bulb within the lamp ballast enclosure. This device is presently lacking in the prior art.

SUMMARY OF THE INVENTION

To provide low-cost but enhanced electrical, thermal, and mechanical protection to a glow bulb starter when installed inside a ballast enclosure, a one-piece plastic glow bulb enclosure has been developed. The enclosure has a housing shaped to receive a conventional glow bulb. A lid is attached to the housing with a living hinge. Latching tabs on the lid engage latching slots in the housing so that the lid is latched in a closed position over the glow bulb.

Slotted openings are formed in a side wall of the housing to accommodate power supply wires which are connected to the glow bulb leads inside the enclosure. An inner wall member on the lid makes contact with the power supply wires as they pass through the slotted wire openings, to provide strain relief. In addition, a partition wall extends upwardly from a bottom wall of the housing to physically isolate the glow bulb leads from each other. Preferably, the power supply wires are ultrasonically welded to the glow bulb leads.

DESCRIPTION OF THE PREFERRED EMBODIMENT

Figure 1:
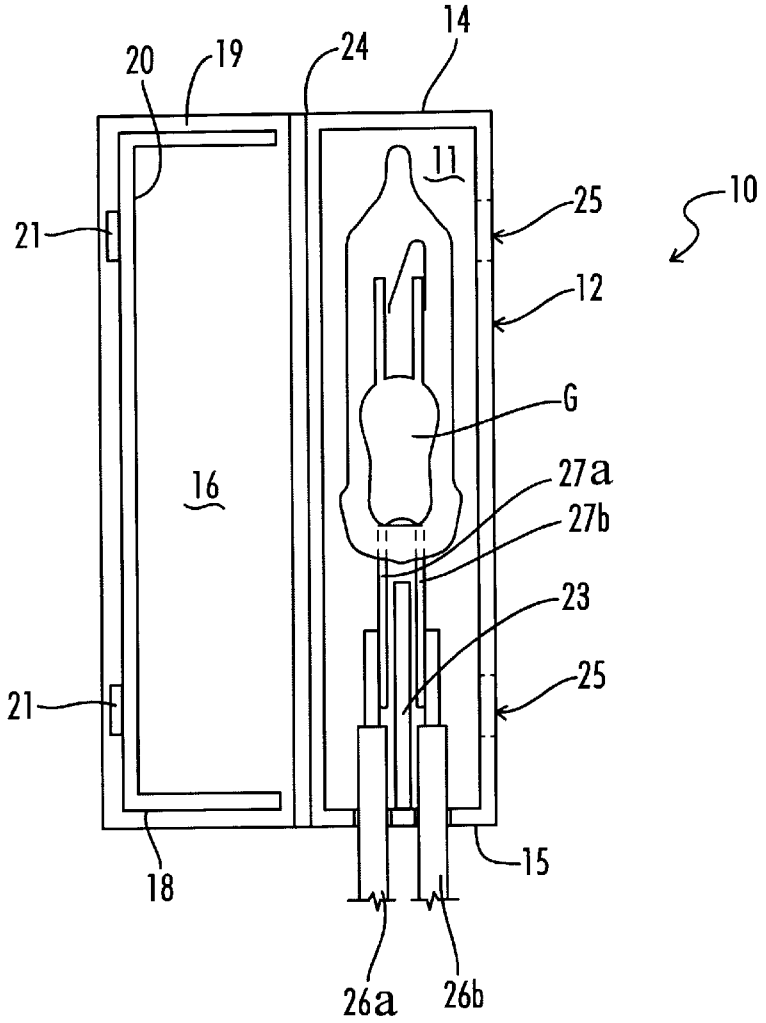
FIG. 1 is a plan view of the glow bulb enclosure of the present invention with the enclosure lid in the open position showing the glow bulb inside the housing of the enclosure.
Figure 2:
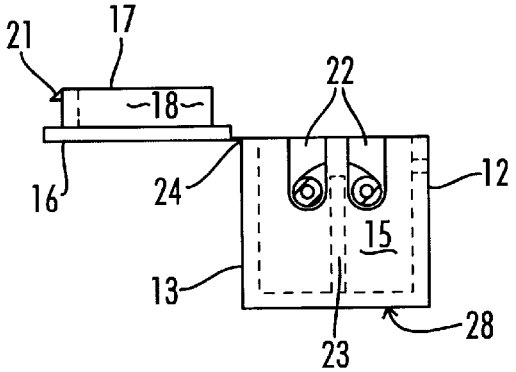
FIG. 2 is an end view of the glow bulb enclosure of FIG. 1 with the lid in the open position.
Figure 3:
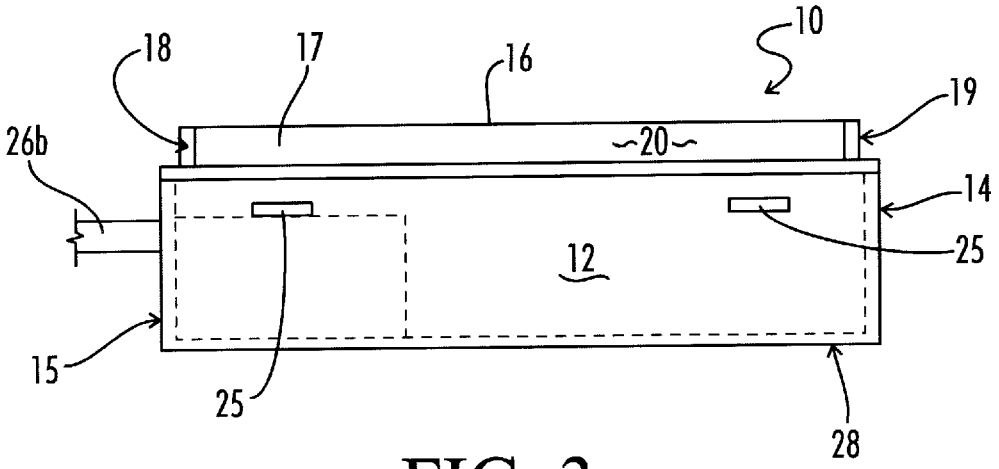
FIG. 3 is a side view of the glow bulb enclosure of FIG. 1.
Figure 4:
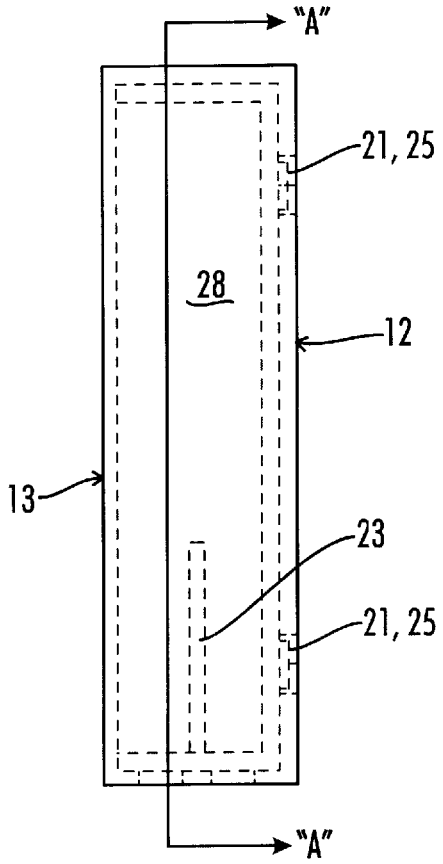
FIG. 4 is a bottom view of the glow bulb enclosure of the present invention with the glow bulb removed
Figure 5:
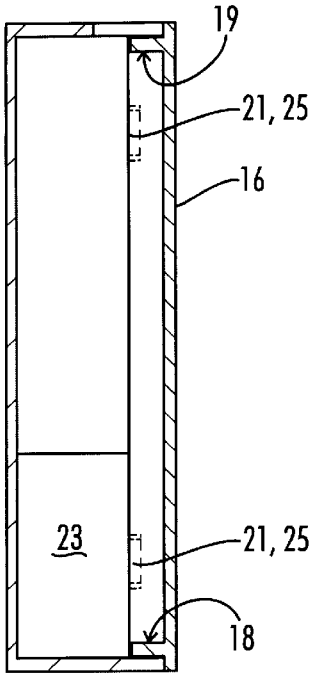
FIG. 5 is a sectional view of the glow bulb enclosure looking along line A—A of FIG. 4.

FIGS. 1 through 5 illustrate the novel glow bulb enclosure 10 of the invention with FIGS. 1, 2, and 3 showing the enclosure 10 with a conventional glow bulb G installed. The enclosure 10 is preferably molded into a one-piece plastic device to form a housing 11 and a corresponding lid 16. The housing has a generally rectangular shape defined by first and second end walls 14, 15, first and second side walls 12, 13, and a bottom wall 28. The top of the housing 11 is left open so that the glow bulb G can be placed inside the housing 11. The dimensions of the housing side, end, and bottom walls 12, 13, 14, 15, and 28 can vary as long as they generally conform to the size and shape of the glow bulb G.

It is important to provide a means for electrically isolating the wire leads 27*a* and 27*b* from each other and to do so in a manner that minimizes manual operations during assembly. Accordingly, the housing 11 includes an integral partition wall 23 which, as best seen on FIGS. 1 and 2, extends vertically upward from the bottom wall 28 to a line between the wire leads 27*a, b* of the glow bulb G. An opening must also be provided into the enclosure 10 for entry of power supply wires 26*a* and 26*b* which are electrically connected inside the housing 11 to the glow bulb wire leads 27*a, b*. Preferably, a pair of slotted wire openings 22 are molded into the second side wall 15 of the housing so that the insulated power supply wires 26*a, b* can pass through and be positioned around the partition wall 23 as shown on FIG. 1.

The power supply wires 26 are soldered or, in the preferred embodiment, ultrasonically welded to the glow bulb wire leads 27. The glow bulb G is placed inside the housing 11 and the lid 16 is pivoted into a closed position over the opening of the housing. Preferably, the lid 16 is attached to the upper margin of second side wall 13 by a living hinge 24.

The outer margins of the lid 16 will preferably be congruent with the size and shape of the opening into the housing 11*b* (i.e., the same size and shape as the bottom wall 28). To provide an additional sealing and latching function, the lid also includes a U-shaped inner sealing structure 17 defined by vertically descending short wall sections 18 and 19, and an interconnecting long wall section 20. The sealing structure 17 is stepped-in slightly from the outer margins of the lid 16 so that the wall sections 18, 19, and 20 will provide a slight frictional fit with the inner surfaces of corresponding walls 15, 14, and 12 respectively of the housing 11.

To provide a further means to secure the lid 16 in its closed position, triangular-shaped latching tabs 21 are integrally molded to and extend laterally outward from the long wall section 20 underneath the lid 16 (FIG. 2). Corresponding latching slots 25 are formed into first side wall 12 of the housing 11. As best seen on FIGS. 4 and 5, when the lid 11 is pivoted into the closed position, the latching tabs 21 are received by the latching slots 25 so that the lid 11 stays closed unless and until the tabs 21 are physically forced out of their respective slots 25.

Because the wire leads 27 on the glow bulb are relatively fragile, strain relief is needed to minimize the forces that can be transmitted by external movement of the power supply wires 26. This function can be performed by the short wall section 18. When the lid 16 is moved to the closed position, the lower edge of the short wall section 18 contacts the supply wires 26 immediately after they pass through the slotted openings 22. Thus, when the lid 16 is latched in the closed position, a strain relief force is applied to the power supply wires 26 between the short wall section 18 and the end wall 15 of the housing 11.

Figure 6:
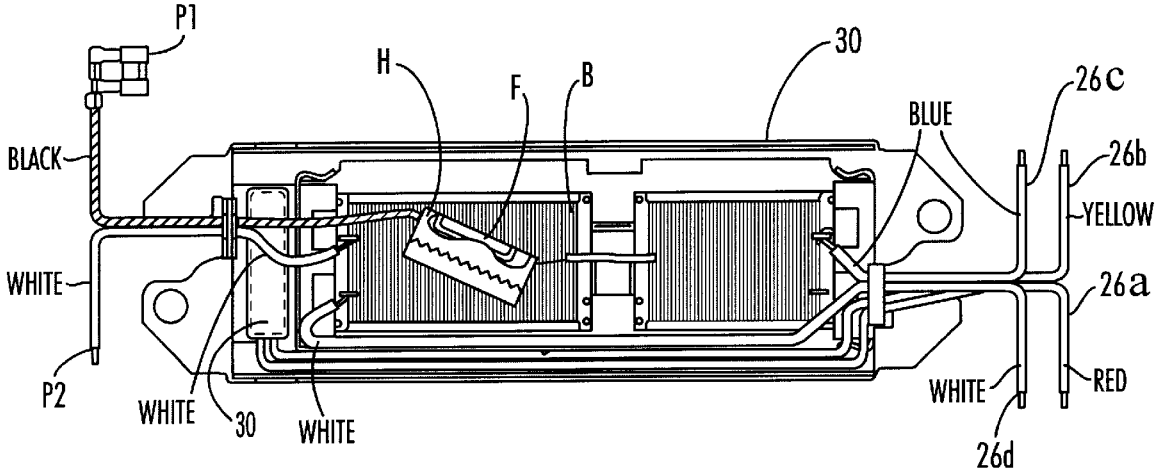
FIG. 6 is a plan view of the glow bulb enclosure of the present invention as installed inside a fluorescent lamp ballast enclosure, with the ballast enclosure cover removed.

FIG. 6 shows a fluorescent lamp ballast and glow bulb assembly, with the cover of the ballast enclosure 30 removed. The glow bulb enclosure 10 of this invention, with the glow bulb G (not shown) inside, is placed inside the ballast enclosure 30 between the magnetic ballast B and a side wall of the ballast enclosure 30. The glow bulb power supply wires 26*a* and 26*b* enter through an opposite side wall of the ballast enclosure 30. Wires 26*a*–26*d* are connected to the lamp terminals (not shown). Main power wires P1 and P2 supply power to the ballast and glow bulb assembly. A thermal protector F inside insulation H provides overheating protection.

Using the glow bulb enclosure 10 as shown and described substantially reduces labor cost. Rather than having to insulate the connections between the power supply wires and glow bulb leads using a manual wrapping operation, the enclosure 10 itself provides this protection. As compared to manually wrapping the entire glow bulb with tape or other material, the enclosure 10 provides an enhanced level of thermal and mechanical shock resistance.

Preferably, the glow bulb enclosure 10 will be molded from low cost plastic which can tolerate the heat generated inside the ballast enclosure 30, such as 6/6 nylon.

Thus, although there have been described particular embodiments of the present invention of a new and useful protective enclosure for glow bulb used with gas discharge lamps, it is not intended that such references be construed as limitations upon the scope of this invention except as set forth in the following claims. Further, although there have been described certain dimensions used in the preferred embodiment, it is not intended that such dimensions be construed as limitations upon the scope of this invention except as set forth in the following claims.

What is claimed is:

1. A protective enclosure for a glow bulb used to start a gas discharge lamp, the glow bulb having a body and first and second wire leads to electrically connect the glow bulb to external power supply leads, comprising:

a. a housing having first and second side walls, first and second end walls joined to the side walls, a bottom wall joined to the side walls and to the end walls, and a top opening, to define a space inside the housing to receive the glow bulb body, where the housing generally conforms to the glow bulb body;

b. at least one wire opening in the housing, the wire opening having a size and shape to allow for mechanical connection of the glow bulb leads to the external power supply leads; and c. a lid having a size and shape which corresponds to the top opening of the housing whereby when the lid is placed on the housing, at least the body of the glow bulb is fully enclosed by the enclosure.

2. The glow bulb enclosure of claim 1 wherein the lid is movably attached to the housing.

3. The glow bulb enclosure of claim 2 wherein the lid is pivotally attached to the housing by a living hinge.

4. The glow bulb enclosure of claim 3 wherein the wire opening comprises first and second slots formed in the second end wall of the housing.

5. The glow bulb enclosure of claim 4 further comprising latching means to latch the lid into a closed position when the lid is pivoted into position over the top opening of the housing.

6. The glow bulb enclosure of claim 5 wherein the latching means comprises at least one latching tab attached to the lid and at least one latching slot formed at a corresponding position on the housing, the latching slot shaped to receive and engage the latching tab whereby the lid is latched into the closed position.

7. The glow bulb enclosure of claim 1 wherein the housing further comprises isolation means for providing an insulating barrier between the first and second wire leads of the glow bulb when the glow bulb body is positioned inside the housing.

8. The glow bulb enclosure of claim 6 wherein the isolation means comprises a partition wall extending vertically upward from the bottom wall inside the housing.

9. The glow bulb enclosure of claim 1 wherein the space defined inside the housing is large enough to receive the first and second wire leads of the glow bulb whereby the entire glow bulb is enclosed by the enclosure.

10. The glow bulb enclosure of claim 9 further comprising strain relief means to mechanically engage and restrain movement of the external power supply leads proximate the wire opening.

11. The glow bulb enclosure of claim 10 wherein the strain relief means comprises a wall member extending vertically downward from the lid into the housing opening whereby the wall member will contact the external power supply leads proximate the wire opening when the lid is closed over the housing.

12. A protective enclosure for a glow bulb having a size and a shape, the glow bulb used to start a gas discharge lamp, the enclosure comprising:

a. a housing having end walls, side walls, and a bottom wall which define a rectangular space inside the housing which will receive the glow bulb, where the housing generally conforms to the size and shape of the glow bulb;

b. a lid movable between an open position and a closed position over the housing;

c. a pair of slotted openings formed in one of the end walls of the housing to allow for entry into the enclosure of external power supply leads; and d. means to secure the lid into the closed position.

13. The enclosure of claim 12 wherein the lid is attached to the housing by a living hinge.

14. The enclosure of claim 13 wherein the means to secure the lid to the housing comprises a latching tab integral to the lid and a corresponding latching slot integral to the housing.

15. The enclosure of claim 14 further comprising a partition wall which is integral to the housing and which, when the glow bulb is placed inside the housing, extends up from the bottom wall of the housing to a position between a pair of wire leads attached to the glow bulb.

16. The glow bulb enclosure of claim 15 wherein the housing and lid comprise a one-piece plastic enclosure.

17. A ballast and glow bulb assembly for starting and operating a gas discharge lamp comprising:

a. a magnetic ballast mounted inside a ballast enclosure;

b. a glow bulb housing sized to conform to the glow bulb assembly and positioned inside the ballast enclosure, the glow bulb housing including a lid;

c. a glow bulb placed inside the housing and underneath the lid; and d. the glow bulb having a pair of electrical leads which are electrically connected inside the glow bulb housing to a pair of glow bulb power supply leads which pass through a wire opening in the housing.

18. The assembly of claim 17 wherein the lid is pivotally attached to the housing.

19. The assembly of the claim 18 further comprising a strain relief member attached to the lid which contacts and restrains the power supply leads inside the housing.

20. The assembly of claim 17 wherein the power supply leads are ultrasonically welded to the electrical leads of the glow bulb.

* * * * *